US012735970B1

(12) United States Patent
Niu et al.

(10) Patent No.: US 12,735,970 B1
(45) Date of Patent: Sep. 15, 2026

(54) WELL PATTERN ARRANGEMENT METHOD FOR IN-SITU LEACHING OF LOW-PERMEABILITY SANDSTONE-TYPE URANIUM DEPOSIT

(71) Applicant: Shijiazhuang Tiedao University, Shijiazhuang (CN)

(72) Inventors: Qinghe Niu, Shijiazhuang (CN); Jiangfang Chang, Shijiazhuang (CN); Wei Wang, Shijiazhuang (CN); Wei Yuan, Shijiazhuang (CN); Yongxiang Zheng, Shijiazhuang (CN); Meng Wang, Shijiazhuang (CN); Songhua Shang, Shijiazhuang (CN)

(73) Assignee: Shijiazhuang Tiedao University, Shijiazhuang (CN)

( * ) Notice: Subject to any disclaimer, the term of this patent is extended or adjusted under 35 U.S.C. 154(b) by 0 days.

(21) Appl. No.: 19/460,199

(22) Filed: Jan. 26, 2026

(30) Foreign Application Priority Data

Sep. 5, 2025 (CN) ..... 202511263875.5

(51) Int. Cl.
*E21B 43/30* (2006.01)
*E21B 43/263* (2006.01)

(52) U.S. Cl.
CPC ..... *E21B 43/30* (2013.01); *E21B 43/263* (2013.01); *E21B 2200/20* (2020.05)

(58) Field of Classification Search
CPC .... E21B 43/30; E21B 43/263; E21B 2200/20; E21B 43/28; E21B 7/046; Y02P 10/20; G06F 2111/10; G06F 30/27; G06F 30/23
See application file for complete search history.

(56) References Cited

U.S. PATENT DOCUMENTS 7,360,595 B2 * 4/2008 Zupanick ..... E21B 41/0064 166/279
2017/0009563 A1 * 1/2017 Holder ..... E21B 43/263
2021/0032970 A1 * 2/2021 Li ..... E21C 41/16
2022/0362820 A1 * 11/2022 Crichlow ..... B09B 1/008
2024/0232450 A1 * 7/2024 Bhuiyan ..... G06F 30/17

FOREIGN PATENT DOCUMENTS

CN 110295901 A 10/2019
CN 112664172 A 4/2021

* cited by examiner

*Primary Examiner* — Yong-Suk (Philip) Ro

(57) ABSTRACT

A well pattern arrangement method for in-situ leaching (ISL) of a low-permeability sandstone-type uranium deposit includes the steps of: performing a geological survey of a target area to delineate a spatial distribution of an ore-bearing layer; arranging horseshoe-shaped horizontal wells based on a horizontal extent of a main ore layer; conducting permeability enhancement by lowering and detonating explosives within the horseshoe-shaped horizontal wells; determining a spacing between the horizontal wells and intervals for explosive placement according to a blast-induced fracturing radius; performing well flushing on the horizontal wells; arranging vertical wells between the horizontal wells, where the horizontal wells are configured for leaching solution injection and the vertical wells are configured for pregnant leach solution (PLS) extraction; and optimizing a spacing between the vertical wells to maximize leaching coverage.

3 Claims, 3 Drawing Sheets

WELL PATTERN ARRANGEMENT METHOD FOR IN-SITU LEACHING OF LOW-PERMEABILITY SANDSTONE-TYPE URANIUM DEPOSIT

CROSS-REFERENCE TO RELATED APPLICATION

This application claims priority of Chinese Patent Application No. 202511263875.5, filed on Sep. 5, 2025, the entire contents of which are incorporated herein by reference.

TECHNICAL FIELD

The present disclosure relates to the technical field of in-situ leaching (ISL) of sandstone-type uranium deposits, and more particularly, to a well pattern arrangement method for ISL of a low-permeability sandstone-type uranium deposit integrating horseshoe-shaped wells and vertical wells.

BACKGROUND

Uranium is a critical raw material for nuclear power generation, making its efficient and environmentally friendly extraction paramount to energy security and sustainable development. Conventional mining methods face significant challenges in low-permeability sandstone-type uranium deposits due to the unique reservoir properties thereof. Consequently, ISL, recognized for its environmental and economic advantages, has become the predominant extraction method for such resources.

A key strategy to enhance recovery rates in ISL operations is to improve the ore layer permeability through reservoir stimulation. Among available techniques, blasting-induced fracturing is one of the most direct and effective. The stress waves and high-pressure gases generated by the explosion effectively drive the propagation of rock fractures, creating a relatively uniform fracture network. This network facilitates the uniform percolation of leaching solutions throughout the ore body. Furthermore, uranium deposits are typically characterized by thin but laterally extensive ore bodies. The application of a conventional five-spot vertical well pattern for extraction presents several challenges, including high well density, limited drainage area per well, and a large surface footprint, all of which contribute to a relatively low return on investment (ROI).

To address these limitations, the present disclosure introduces the application of horseshoe horizontal well technology to the ISL of uranium deposits. According to the disclosed method, reservoir permeability is enhanced via blasting conducted through the horseshoe-shaped wells. Subsequently, these same wells are used as injection wells for the leaching solution, while strategically arranged vertical wells function as extraction wells. The entire well pattern is optimized and evaluated. Compared with the conventional five-spot vertical well pattern, this method is theoretically better suited for the extraction of uranium from such deposits. It represents an effective means of improving overall recovery rates and per-well productivity, thereby offering significant engineering and economic value.

SUMMARY

In view of the foregoing, an objective of the technical solution of the present disclosure is to provide a well pattern arrangement method for ISL of a low-permeability sandstone-type uranium deposit. The method employs an integrated system of horseshoe-shaped wells and vertical wells, where the horseshoe-shaped wells are configured for permeability enhancement via blasting and for leaching solution injection, and the vertical wells are configured for pregnant leach solution (PLS) extraction. By optimizing spacings of horizontal sections of the horseshoe-shaped wells and the vertical wells, the method effectively minimizes leaching dead zones and maximizes the overall leaching coverage.

To realize the above objective, the present disclosure employs the following technical solution:

a well pattern arrangement method for ISL of a low-permeability sandstone-type uranium deposit includes the steps of:

step (1), performing geological exploration on a target ore layer to obtain a refined three-dimensional (3D) geological model; determining a length of a horizontal section of a horseshoe-shaped well based on an extension range of the target ore layer; arranging locations of blasting points according to a blasting scheme; and designing a spacing L1 between horizontal sections of a single horseshoe-shaped well and a spacing L2 between adjacent horizontal sections of two horseshoe-shaped wells based on a fracturing range of blasting stress waves;

step (2), arranging a first set of vertical wells, each vertical well of the first set being located at a midpoint between the horizontal sections of the single horseshoe well, and arranging a second set of vertical wells, each vertical well of the second set being located at a midpoint between the adjacent horizontal sections of the two horseshoe wells; and step (3), loading explosives at the blasting points within the horizontal section of the horseshoe-shaped well and at corresponding positions within the vertical wells that are aligned with the horizontal section, in which a spacing between adjacent blasting points within the horseshoe-shaped well is defined as L3; a spacing between two vertical wells of the first set is defined as L4; and the blasting points within the horizontal section of the horseshoe-shaped well and those within the vertical wells form a five-spot pattern on a common horizontal plane, with L1=L3=L4.

Preferably, in step (1), the 3D geological model includes a strike, a thickness, a width, and a spatial distribution of the target ore layer.

Preferably, in step (1), the spacing L2 between the adjacent horizontal sections of the two horseshoe-shaped wells is less than the spacing L1 between the horizontal sections of the single horseshoe-shaped well.

Preferably, a well spacing within the second set is less than a well spacing within the first set.

Preferably, explosives are further loaded in the vertical wells at positions above and below the horizontal plane defined by the horizontal section of the horseshoe-shaped well, and a total charge weight at the positions above and below the horizontal plane exceeds a charge weight at positions on the horizontal plane.

Preferably, the explosives include an emulsion explosive charged in a columnar configuration.

Based on the aforementioned technical solutions, and in comparison with the related art, the present disclosure provides a well pattern arrangement method for ISL of a low-permeability sandstone-type uranium deposit, which delivers the following beneficial effects.

By employing horseshoe-shaped well technology, the present disclosure provides significant advantages over the conventional five-spot vertical well pattern: increased injection capacity, higher sweep efficiency, and a larger leaching area per well. Consequently, leaching dead zones are significantly reduced, resulting in a higher ROI.

The present disclosure achieves dual-purpose functionality in the wells. Initially, the wells are used for reservoir stimulation via blasting, where the horizontal sections control the fracture network within the horizontal plane of the ore layer, and the vertical wells control the vertical fracture extent. Subsequently, the same wells function for fluid injection and extraction. This integrated approach not only improves reservoir permeability but also increases the volume of ore influenced by each well.

The present disclosure achieves a reduction in the number of vertical wells required. Through a rational arrangement, a reduced well pattern is capable of efficient PLS extraction and of utilizing the drawdown pressure to promote leaching solution migration within the ore layer.

BRIEF DESCRIPTION OF THE DRAWINGS

To illustrate the embodiments of the present disclosure or the related art more clearly, the accompanying drawings to be used in the description of the embodiments or the related art are briefly introduced below. Obviously, the drawings in the following description are merely some embodiments of the present disclosure. Those of ordinary skill in the art may derive other drawings from these provided ones without creative efforts.

Figure 1:
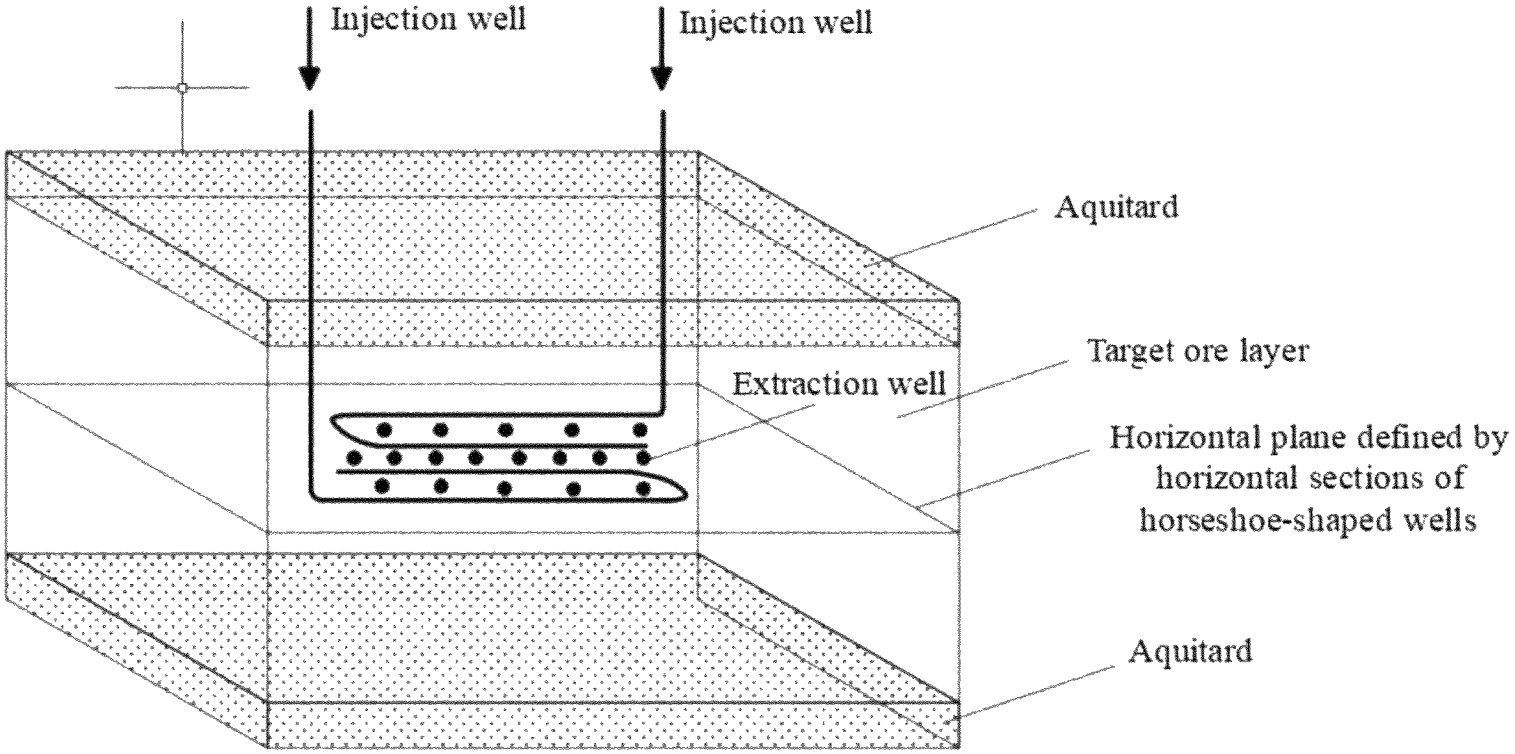
FIG. 1 is a 3D perspective view of a well pattern structure.

Reference numerals and denotations thereof: 1—horseshoe-shaped well injection end; 2—horseshoe-shaped well sealed end; 3—vertical well; and 4—blasting point.

DETAILED DESCRIPTION

The technical solutions of the present disclosure are further described clearly and completely below with reference to the embodiments. Obviously, the embodiments described are only some, rather than all embodiments of the present disclosure. Based on the embodiments of the present disclosure, all other embodiments obtained by those of ordinary skill in the art without creative effort fall within the scope of protection of the present disclosure.

Figure 2:
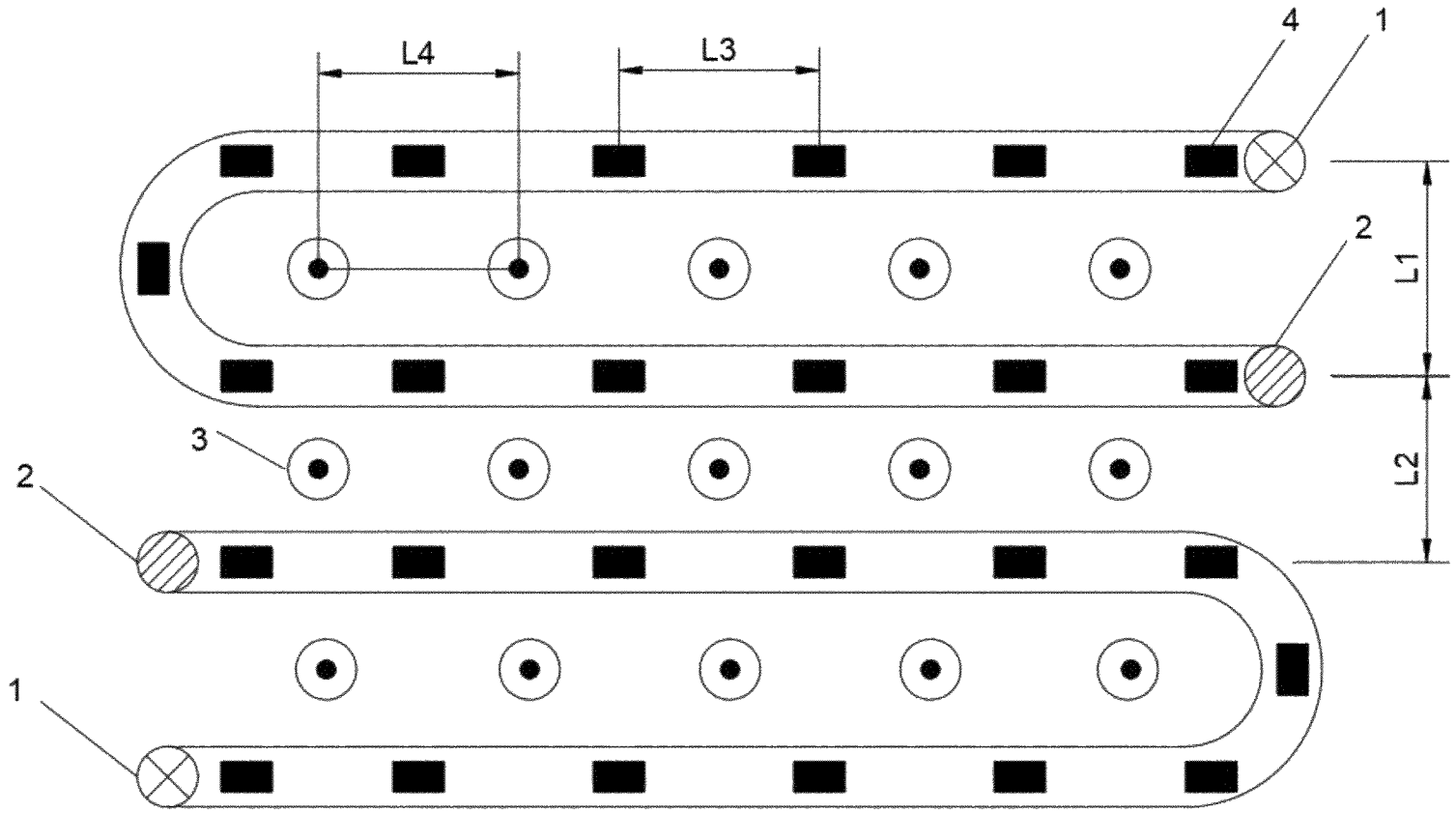
FIG. 2 is a horizontal cross-sectional view.
Figure 3:
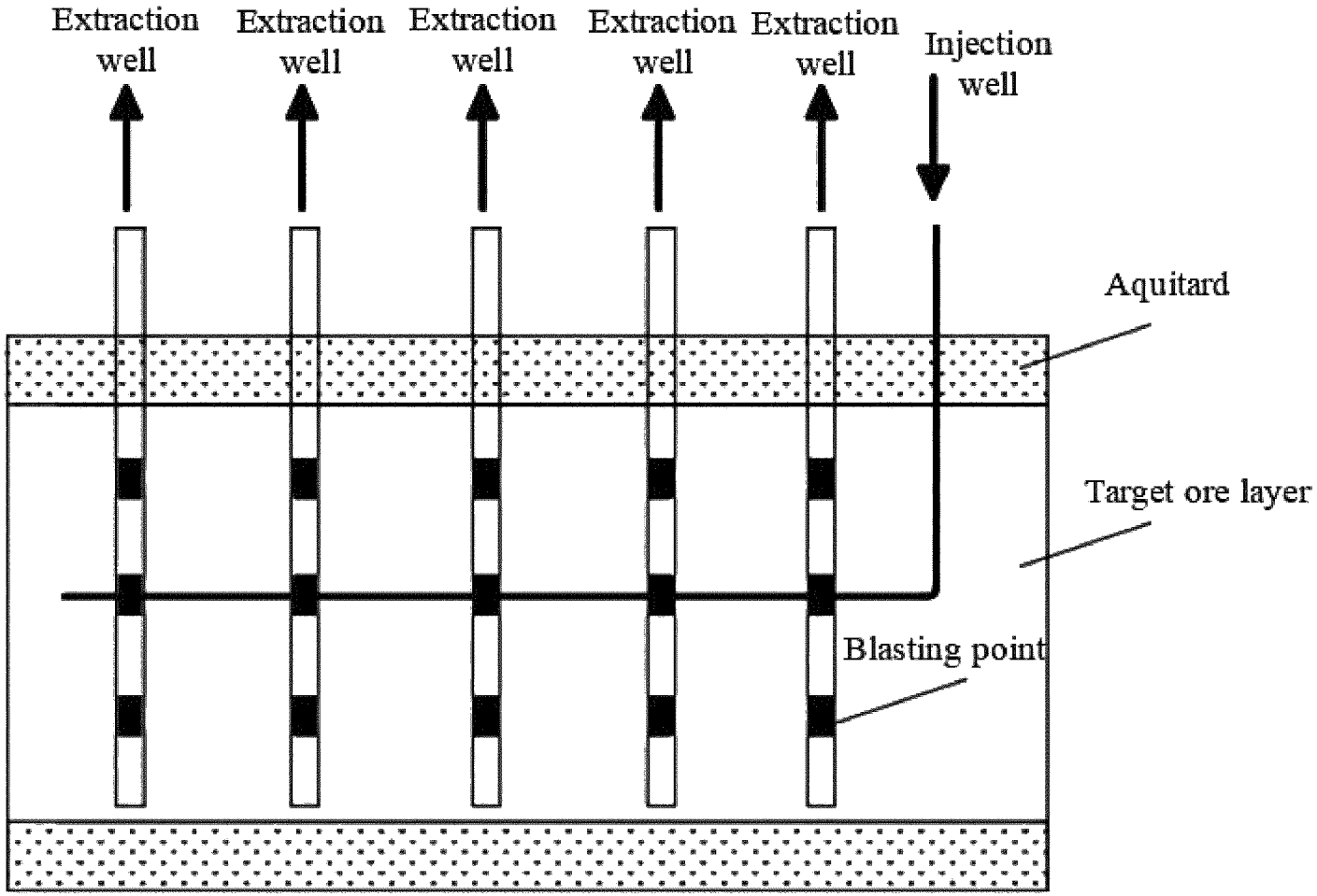
FIG. 3 is a vertical cross-sectional view.

Referring to FIGS. 1-3, a well pattern arrangement method for ISL of a low-permeability sandstone-type uranium deposit includes the following steps:

In step (1), geological exploration is performed on a target ore layer to obtain a refined 3D geological model, from which basic spatial distribution parameters such as strike, thickness, and width of the target ore layer are acquired. Based on an extension range of the target ore layer, a length of a horizontal section of a horseshoe-shaped well is determined. Locations of blasting points 4 are arranged according to a blasting scheme. A spacing L1 between horizontal sections of a single horseshoe-shaped well and a spacing L2 between adjacent horizontal sections of two horseshoe-shaped wells are designed based on a fracturing range of blasting stress waves (as shown in FIG. 2), where L2 is designed to be less than L1. Specifically, these spacings can be optimized through multiple sets of experiments to maximize leaching coverage. Adopting a smaller L2 can enhance the fracturing synergy between the horizontal sections of the two adjacent horseshoe-shaped wells. It can also mitigate permeability loss at the ends of these sections, which is caused by diminished seepage pressure resulting from hydraulic pressure drop and energy dissipation. Simultaneously, the drawdown pressure generated by pumping from the centrally located vertical well can also promote leaching solution migration.

In step (2), a first set and a second set of vertical wells 3 are arranged. Each vertical well of the first set is located at a midpoint between the horizontal sections of the single horseshoe well, and each vertical well of the second set is located at a midpoint between the adjacent horizontal sections of the two horseshoe wells. A spacing between two vertical wells of the first set is defined as L4.

In step (3), explosives are loaded at the blasting points within the horizontal section of the horseshoe-shaped well and at corresponding positions within the vertical wells 3 that are aligned with the horizontal section. A spacing between adjacent blasting points within the horseshoe-shaped well is defined as L3. The blasting points within the horizontal section of the horseshoe-shaped well and those within the vertical wells 3 form a five-spot pattern on a common horizontal plane (a structure as shown in FIG. 2), with L1=L3=L4, thereby ensuring overlap and interconnection of the induced fractures.

In some specific embodiments, the spacing between the vertical wells 3 located at the midpoint between the adjacent horizontal sections of the two horseshoe-shaped wells is smaller than the spacing L4 between the vertical wells located at the midpoint between the horizontal sections of the single horseshoe-shaped well, to compensate for the decrease in injection pressure at the horizontal section ends.

In some specific embodiments, as shown in FIG. 3, explosives are also loaded in the vertical wells 3 at positions above and below the horizontal plane defined by the horizontal section of the horseshoe-shaped well. A total charge weight at the positions above and below the horizontal plane exceeds a charge weight at positions on the horizontal plane, to obtain a uniform and interconnected fracture network.

In some specific embodiments, the explosives include an emulsion explosive charged in a columnar configuration.

A specific principle of the above technical solution is as follows. The horseshoe-shaped horizontal wells and vertical wells are used as blasting wells. Explosives are rationally arranged according to geological conditions to perform blasting treatment on the target ore layer, thereby creating a relatively uniform fracture network. This network facilitates the uniform percolation of the leaching solution during subsequent ISL operations. The blasting scheme is designed in conjunction with formation characteristics, and the blasting points arranged within the horseshoe-shaped horizontal wells and vertical wells form a spatial array structure (such as a five-spot pattern) to uniformly cover the target ore layer. After the blasting treatment of the ore layer is completed, the wellbores are inspected, and well flushing is performed if necessary. Subsequently, the horseshoe-shaped horizontal wells function as injection wells, with one end for solution injection (horseshoe-shaped well injection end 1) and the other end sealed (horseshoe-shaped well sealed end 2). The vertical wells act as extraction wells. The addition of a row of vertical wells between the two horseshoe-shaped horizontal wells is specifically to address the hydraulic pressure drop along the horizontal flow paths. This pressure drop creates a zone of diminished hydraulic drive between the wells, a condition that is effectively counteracted by the intermediate extraction wells.

In the specification, the embodiments are described in progressive order. Each embodiment primarily emphasizes distinctions from other embodiments, while identical or similar aspects across embodiments may be cross-referenced. Regarding the device disclosed in the embodiments, since the device corresponds directly to the method disclosed in the embodiments, the description is relatively simple, with relevant details incorporated by reference to the method section.

The foregoing description of the disclosed embodiments causes those skilled in the art to implement or utilize the present disclosure. Various modifications to these embodiments are obvious to those skilled in the art. The general principles defined herein may be implemented in other embodiments without departing from the spirit or scope of the present disclosure. Therefore, the present disclosure is not to be limited to the embodiments shown herein, but is to be accorded the broadest scope consistent with the principles and novel features disclosed in the present disclosure.

The invention claimed is:

1. A well pattern arrangement method for in-situ leaching (ISL) of a low-permeability sandstone-type uranium deposit, comprising the steps of:

step (1), performing geological exploration on a target ore layer to obtain a refined three-dimensional (3D) geological model, the 3D geological model comprising a strike, a thickness, a width, and a spatial distribution of the target ore layer; determining a length of a horizontal section of a horseshoe-shaped well based on an extension range of the target ore layer; arranging locations of blasting points according to a blasting scheme; and designing a spacing L1 between horizontal sections of a single horseshoe-shaped well and a spacing L2 between adjacent horizontal sections of two horseshoe-shaped wells based on a fracturing range of blasting stress waves, wherein L2<L1;

step (2), arranging a first set of vertical wells, each vertical well of the first set being located at a midpoint between the horizontal sections of the single horseshoe-shaped well, and arranging a second set of vertical wells, each vertical well of the second set being located at a midpoint between the adjacent horizontal sections of the two horseshoe-shaped wells, wherein a well spacing within the second set is less than a well spacing within the first set; and step (3), loading explosives at the blasting points within the horizontal section of the horseshoe-shaped well and at corresponding positions within the vertical wells that are aligned with the horizontal section, wherein a spacing between adjacent blasting points within the horseshoe-shaped well is defined as L3; a spacing between two vertical wells of the first set is defined as L4; and the blasting points within the horizontal section of the horseshoe-shaped well and those within the vertical wells form a five-spot pattern on a common horizontal plane, with L1=L3=L4.

2. The well pattern arrangement method for ISL of a low-permeability sandstone-type uranium deposit according to claim 1, wherein explosives are further loaded in the vertical wells at positions above and below the horizontal plane defined by the horizontal section of the horseshoe-shaped well, and a total charge weight at the positions above and below the horizontal plane exceeds a charge weight at positions on the horizontal plane.

3. The well pattern arrangement method for ISL of a low-permeability sandstone-type uranium deposit according to claim 1, wherein the explosives comprise an emulsion explosive charged in a columnar configuration.

* * * * *